US006679820B2

(12) United States Patent
Barkus et al.

(10) Patent No.: US 6,679,820 B2
(45) Date of Patent: Jan. 20, 2004

(54) METHOD FOR ENERGY MANAGEMENT AND OVERSPEED PROTECTION OF A CENTRIFUGE

(75) Inventors: David Alan Barkus, Oakville, CT (US); Raymond Gary Potter, Southbury, CT (US)

(73) Assignee: Kendro Laboratory Products, LP, Newtown, CT (US)

( * ) Notice: Subject to any disclaimer, the term of this patent is extended or adjusted under 35 U.S.C. 154(b) by 225 days.

(21) Appl. No.: 09/989,780

(22) Filed: Nov. 20, 2001

(65) Prior Publication Data

US 2002/0077240 A1 Jun. 20, 2002

Related U.S. Application Data

(62) Division of application No. 09/547,285, filed on Apr. 11, 2000, now Pat. No. 6,368,265.

(51) Int. Cl.[7] ..... B04B 13/00

(52) U.S. Cl. ..... 494/8; 494/9; 494/10; 494/37; 700/273; 700/275; 700/304

(58) Field of Search ..... 494/7–10, 12, 494/37, 84; 700/273, 275, 304; 702/96, 141, 145, 147, 41, 44; 324/160–162; 318/476

(56) References Cited

U.S. PATENT DOCUMENTS

| | | | | | |
|---|---|---|---|---|---|
| 3,462,670 | A | * | 8/1969 | Waye | 318/464 |
| 3,582,699 | A | * | 6/1971 | Badessa et al. | 388/809 |
| 3,636,545 | A | * | 1/1972 | Boyd et al. | 702/147 |
| 3,746,247 | A | | 7/1973 | Camilliere | |
| 3,832,614 | A | * | 8/1974 | Olliffe | 388/811 |
| 3,921,047 | A | * | 11/1975 | Carter et al. | 388/844 |
| 4,096,988 | A | | 6/1978 | Scuricini | |
| 4,205,261 | A | | 5/1980 | Franklin | 318/480 |
| 4,223,829 | A | | 9/1980 | Bange | |
| 4,244,513 | A | | 1/1981 | Fayer et al. | |
| 4,284,931 | A | * | 8/1981 | Ehret | 388/814 |
| 4,456,581 | A | | 6/1984 | Edelmann et al. | 422/72 |
| 4,507,110 | A | | 3/1985 | Boeckel | 494/10 |
| 4,515,582 | A | | 5/1985 | Cox-Smith et al. | 494/7 |
| 4,551,715 | A | | 11/1985 | Durbin | 340/671 |
| 4,601,696 | A | | 7/1986 | Kamm | 494/10 |
| 4,700,117 | A | | 10/1987 | Giebeler et al. | 318/327 |
| 4,772,254 | A | | 9/1988 | Grassi et al. | 494/10 |
| 4,827,197 | A | | 5/1989 | Giebeler | 318/3 |
| 4,857,811 | A | | 8/1989 | Barrett et al. | 318/3 |
| 4,903,191 | A | * | 2/1990 | Fries | 700/3 |
| 4,960,406 | A | | 10/1990 | Gorodissky et al. | 494/9 |
| 5,037,371 | A | | 8/1991 | Romanauskas | 494/10 |
| 5,207,634 | A | | 5/1993 | Greenstein | 494/10 |
| 5,221,250 | A | | 6/1993 | Cheng | 494/7 |
| 5,235,864 | A | | 8/1993 | Rosselli et al. | 73/865.9 |
| 5,338,283 | A | | 8/1994 | Fleming et al. | 494/10 |
| 5,382,218 | A | | 1/1995 | Uchida | 494/10 |
| 5,383,838 | A | | 1/1995 | Cheng et al. | 494/10 |
| 5,431,620 | A | | 7/1995 | Schenck et al. | 494/7 |
| 5,509,881 | A | | 4/1996 | Sharples | 494/7 |
| 5,518,493 | A | | 5/1996 | Srinivasan | 494/10 |
| 5,600,076 | A | | 2/1997 | Fleming et al. | 73/865.9 |
| 5,649,893 | A | | 7/1997 | Inaniwa et al. | 494/9 |
| 5,650,578 | A | | 7/1997 | Fleming et al. | 73/865.9 |
| 5,665,047 | A | | 9/1997 | Brimhall | 494/16 |
| 5,726,881 | A | * | 3/1998 | Inaniwa et al. | 700/79 |
| 5,738,622 | A | | 4/1998 | Niinai et al. | 494/7 |
| 5,752,910 | A | | 5/1998 | Cheng | 494/7 |
| 5,800,331 | A | | 9/1998 | Song | 494/7 |
| 6,205,405 | B1 | * | 3/2001 | Pouvreau | 702/41 |

FOREIGN PATENT DOCUMENTS

| | | | |
|---|---|---|---|
| DE | 19632965 A1 | * | 2/1998 |
| DE | 19730587 A1 | * | 2/1998 |
| WO | WO 87/00770 A1 | * | 2/1987 |

* cited by examiner

*Primary Examiner*—Charles E. Cooley
*Assistant Examiner*—David Sorkin
(74) *Attorney, Agent, or Firm*—Baker & Hostetler LLP

(57) ABSTRACT

There is provided a method for limiting an operating speed of a rotor installed in a centrifuge system. The method includes the steps of (a) determining whether an actual change in energy required to accelerate the rotor from a first speed to a second speed is within a predetermined range of an expected change in energy required to accelerate the rotor from the first speed to the second speed, and (b) limiting the operating speed when the actual change in energy is not within the predetermined range of the expected change in energy.

13 Claims, 12 Drawing Sheets

METHOD FOR ENERGY MANAGEMENT AND OVERSPEED PROTECTION OF A CENTRIFUGE

The present application is a divisional of U.S. patent application Ser. No. 09/547,285, which was filed on Apr. 11, 2000, now U.S. Pat. No. 6,368,265.

BACKGROUND OF THE INVENTION

1. Field of the Invention

The present invention relates to centrifuge systems and more particularly, to a method of limiting the operating speed of a centrifuge rotor when an actual operating parameter value of the rotor is not within a predetermined range of an expected operating parameter value of the rotor.

2. Description of the Prior Art

A centrifuge instrument is a device by which liquid samples may be subjected to centrifugal forces. The sample is carried within a member known as a centrifuge rotor. The rotor is mounted to a rotatable drive shaft that is connected to a source of motive energy.

The centrifuge instrument may accept any one of a plurality of different centrifuge rotors depending upon the separation protocol being performed. Whatever rotor is being used, however, it is important to insure that the rotor does not attain an energy level that exceeds the capacity of the energy containment system of the instrument, or that exceeds a predetermined amount of centrifuge movement as a result of a rotor failure.

The energy containment and centrifuge movement reduction system(s) include all structural features of the centrifuge instrument that cooperate to confine within the instrument any fragments produced in the event of a rotor failure. These structural features include, for example, one (or more, concentric) guard ring(s), instrument chamber door and associated door latches. The energy containment system, however configured, has an energy containment threshold.

The total energy input to a system is equal to the sum of the energy dissipated in operation and the stored energy. Applied energy is stored by the rotation of the rotor. If the stored energy of a failed rotor exceeds the energy containment threshold of the instrument a fragment of the rotor may not be confined by the containment system. It is the stored energy that must be contained in the event of rotor failure.

The stored energy of motion, or the kinetic energy, of a rotor is directly related to its angular velocity, as specified by the relationship:

$$\text{Kinetic Energy} = \tfrac{1}{2}(I\omega^2)$$

where I is the moment of inertia of the rotor, and where $\omega$ is its angular velocity.

Presently, the most direct manner of limiting rotor energy is to limit the velocity, i.e., the angular velocity or the speed, that the rotor is able to attain. It is also important to limit a rotor to its rated speed to insure its longevity, and the integrity of the samples, containers and centrifugation result.

One manner of rotor speed limitation is achieved by windage limiting the rotor. Windage limitation is a passive speed limitation technique. Windage limitation is the state of equilibrium between delivered motor torque and air friction losses of the rotor at a steady state speed.

Another way to limit rotor speed is to provide an overspeed control system in the instrument that affirmatively, or actively, limits the speed at which each given rotor is allowed to spin. For an active overspeed control system to limit rotor speed effectively it must typically ascertain the identity of the rotor mounted in the instrument.

Rotor identity information may be directly derived from the operator by requiring that the operator input identity information to the control system prior to the initiation of a centrifugation run. However, to protect against the possibility of an operator error, independent rotor identity arrangements are used. These rotor identity arrangements identify the rotor present on the drive shaft of the instrument and, based on this identification, permit the rotor to reach only a predetermined allowable speed.

Various forms of independent rotor identity arrangements are known. In one form each rotor in a rotor family carries a speed decal having bands or sectors of differing light reflectivity. A code is read by an associated sensor at a predetermined low angular velocity. This technique establishes an acceptable maximum rotor speed based on a rate of alternating light and dark pulses. In another form each rotor in the family carries a predetermined pattern of magnets. The magnets are sensed by a suitable detector, typically a Hall Effect device, to read the rotor code. U.S. Pat. No. 4,601,696 to Kamm is representative of this form of rotor identity arrangement.

Other arrangements for independent rotor identity sense a particular parameter of rotor construction in order to identify the rotor. In the arrangement disclosed in U.S. Pat. No. 5,037,371 to Romanauskas, the shape of a rotor mounted on the drive shaft is interrogated ultrasonically to generate a signal representative of the rolor's identity. In U.S. Pat. No. 4,827,197 to Giebeler, the inertia of the rotor mounted on the shaft is detected and used as a basis for rotor identity.

Some overspeed protection systems limit operating speed based on a monitored operating parameter of a rotor rather than on the identity of the rotor. U.S. Pat. Nos. 5,600,076 and 5,650,578, both to Fleming et al., describe systems that monitor applied accelerating energy in order to ensure that the applied energy does not exceed the containment capability of the centrifuge chamber. The decision of whether to limit speed is made independent of the identity of the rotor, and it does not consider the expected behavior of the rotor.

There is a need for a method of overspeed protection that considers whether an actual operating parameter of a rotor is within a predetermined range of an expected value of the operating parameter of the rotor, and then limits the rotor speed based on the actual parameter.

SUMMARY OF THE INVENTION

The present invention is a method and system for limiting an operating speed of a centrifuge rotor. The method includes the steps of determining whether an actual parameter value of the rotor is within a predetermined range of an expected parameter value of the rotor, and limiting the operating speed when the actual parameter value is not within the predetermined range of the expected parameter value. At least one of the following determinations are made: (i) whether an actual energy required to accelerate the rotor from rest to a predetermined speed is within a predetermined range of an expected energy required to accelerate the rotor from rest to the predetermined speed, (ii) whether an actual change in energy required to accelerate the rotor from a first speed to a second speed is within a predetermined range of an expected change in energy required to accelerate the rotor from the first speed to the second speed, (iii) whether an actual energy loss due to windage of the rotor is within a predetermined range of an expected energy loss due to windage of the rotor, (iv) whether an actual time required to accelerate the rotor from a first speed to a second speed is within a predetermined range of an expected time required to accelerate the rotor from the first speed to the second speed, (v) whether an actual speed of the rotor is within a predetermined range of an expected speed of the rotor at a predetermined time, and (vi) whether an actual ratio of change in acceleration and difference of drag torque speed terms of the rotor is within an predetermined range of an expected ratio of change in acceleration and difference of drag torque speed terms.

DETAILED DESCRIPTION OF THE INVENTION

The present invention is a method of overspeed protection of a centrifuge rotor that considers whether an actual value of an operating parameter of the rotor is within a predetermined range of an expected value of the operating parameter. The operating speed of the rotor is limited when the actual value of the parameter is not within the predetermined range of the expected value.

The method evaluates six parameters, namely (1) energy required to accelerate the rotor from rest to a predetermined speed; (2) a change in energy required to accelerate the rotor from a first speed to a second speed; (3) an energy loss due to windage of the rotor; (4) a time required to accelerate the rotor from a first speed to a second speed; (5) a speed of the rotor at a predetermined time, and (6) a ratio of change in acceleration and difference of drag torque speed terms of the rotor. Although each of the six parameters can serve as an independent basis for limiting the speed of the rotor, the preferred embodiment of the method considers the group collectively.

Figure 1:
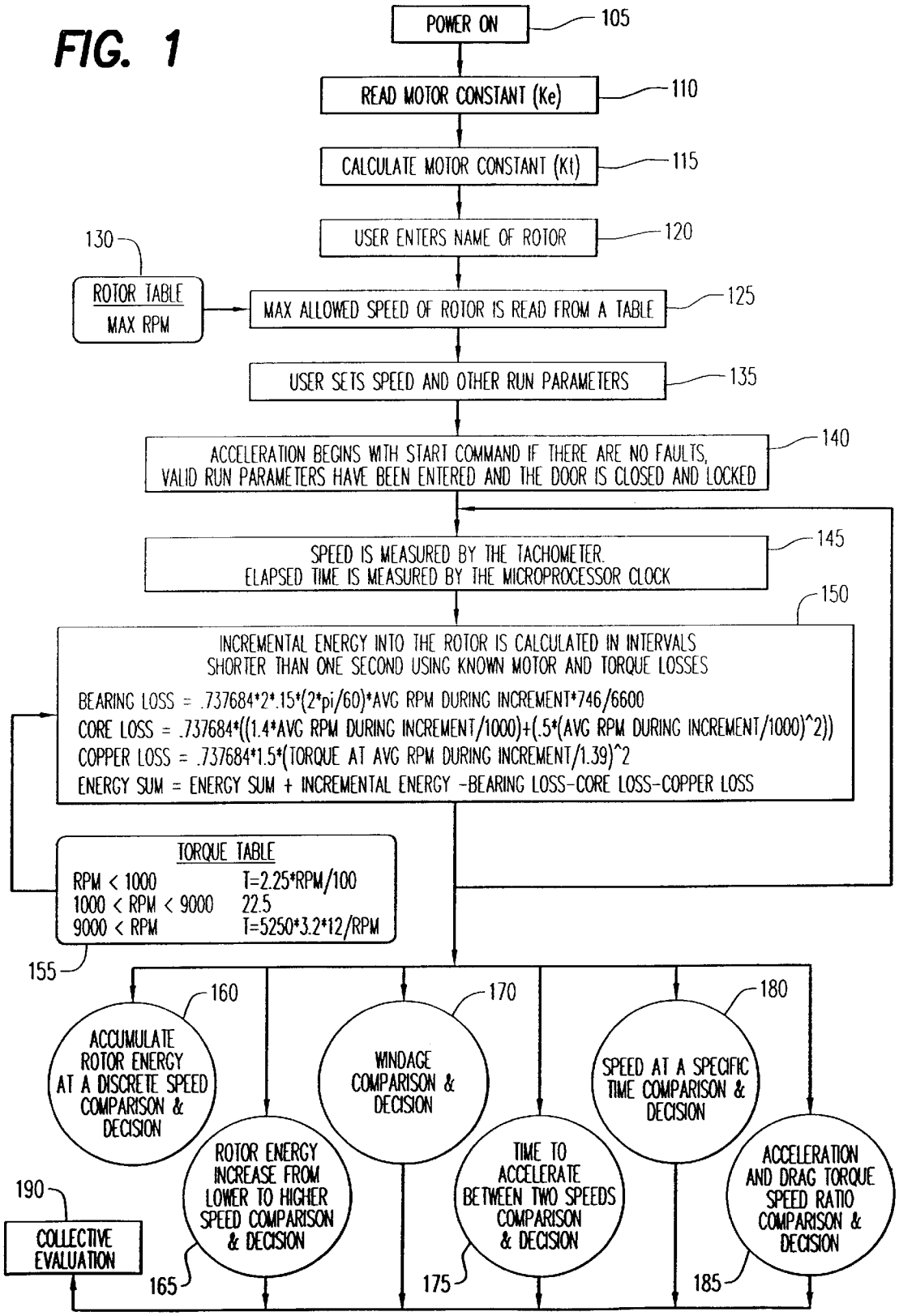
FIG. 1 is a flowchart of a preferred method for limiting the operating speed of a centrifuge rotor in accordance with the present invention.

FIG. 1 is a flowchart of a preferred method for limiting the operating speed of a centrifuge rotor in accordance with the present invention. This method evaluates six parameters as indicated by steps 160, 165, 170, 175, 180 and 185. A method for evaluating each of these six parameters is presented separately, after the discussion of the integrated method of FIG. 1. The method begins with step 105.

In step 105, centrifuge power is turned on. The method then advances to step 110.

In steps 110 and 115, a motor constant $K_t$ is determined. The motor constant $K_t$ is a measure of the torque output of the motor at an applied unit of current through the motor. $K_t$ is calculated from a motor constant $K_e$, which may be determined by measuring the average voltage generated by the motor while the motor shaft rotates at a predetermined angular velocity. In step 110, the motor constant $K_e$, which is typically represented in units of volts/1000 revolutions per minute (rpm), is read from a microchip on the centrifuge motor. The method then advances to step 115 in which the motor constant $K_t$, which is typically represented in units of inch-lb torque per amp, is calculated according to the formula:

$$K_t=0.0845\times K_e$$

The method then advances to step 120.

In step 120, a user identifies the centrifuge rotor that is installed in the centrifuge. The centrifuge system receives a rotor name or some other form of rotor identification from the user. Under normal circumstances, the user intends to correctly identify the rotor installed in the centrifuge, but the present invention deals with the situation in which the user incorrectly identifies the rotor. Alternatively, the rotor identification can be obtained independently such as by interrogating a device integrated into the rotor assembly. The method then advances to step 125.

In step 125, a maximum speed for the rotor is determined. The maximum speed is obtained from a rotor table 130, which is indexed by the rotor identification obtained in step 120. The method then advances to step 135.

In step 135, the user specifies an operating speed and other parameters for the centrifuge session. The method determines a set speed for the centrifuge that is limited to the maximum speed determined in step 125. The method then advances to step 140.

In step 140, acceleration of the centrifuge rotor begins provided that there are no system faults, valid run parameters have been entered by the user, and the centrifuge door is closed and locked. The method then advances to step 145.

In step 145, rotor speed, i.e., angular velocity, and elapsed time for the session are measured. Typically, the actual angular velocity is measured by a tachometer and the elapsed time is measured by a microprocessor clock. The elapsed time is further employed to determine a time interval for calculations such as those shown below. The method then advances to step 150.

In step 150, actual incremental energy ($E_a$) applied to the rotor during a time interval (t) is determined according to the formula:

$$E_a=[K_t\tau_a\omega_a t]$$

where: t=a time interval, $\omega_a$=actual average angular velocity during time interval (t), $\tau_a$=actual average motor torque during time interval (t), and $K_t$=motor constant (from step 115).

Actual average motor torque ($\tau_a$) is read from a torque table 155, which is indexed by the actual average angular velocity ($\omega_a$) or equivalently RPM=$2\pi\omega_a$, which was measured in step 145.

| RPM | Torque |
|---|---|
| RPM < 1000 | 2.25 × RPM/100 |
| 1000 ≦ RPM < 9000 | 22.5 |
| 9000 ≦ RPM | 5250 × 3.2 × 12/RPM |

Alternatively, actual average motor torque ($\tau_a$) can be calculated from the formula:

$$\tau_a = K_t \times I$$

where: $K_t$=motor constant (from step 115), and

I=electric current, in amps, through the centrifuge motor.

The actual energy ($E_a$) is calculated and accumulated in time increments of less than one second by looping back to step 145 until a predetermined amount of time has elapsed, and the rotor has reached a predetermined angular velocity. In the interim, the accumulated energy is calculated incrementally.

Representative values of the actual average angular velocity ($\omega_a$) and the actual average motor torque ($\tau_a$) can be used for the calculation of the actual incremental energy ($E_a$). A representative speed of the rotor during the time interval (t) is a speed between a speed at the beginning of the time interval and a speed at the end of the time interval, inclusive. For example, the representative speed can be approximated by an average of the speed at the beginning of the time interval and the speed at the end of the time interval. Likewise, a representative torque applied to the motor during time interval (t) is a torque between a torque at the beginning of the time interval and a torque at the end of the time interval, inclusive. A representative torque can be approximated by an average of a torque at the beginning of the time interval and a torque at the end of the time interval. Generally, such approximations are more accurate in the case of a shorter time interval rather than a longer time interval.

Step 150 also accounts for incremental motor losses. The motor losses include bearing loss, core loss and copper loss, all of which are commonly known in the art of motor design.

$$\text{Bearing Loss} = 0.737684 \times 2 \times 0.15 \times 2\pi/60 \times Avg.\ RPM \times 746/6600.$$

$$\text{Core Loss} = 0.737684 \times ((1.4 \times Avg.\ RPM/1000) + (0.5 \times Avg.\ RPM/1000)^2).$$

$$\text{Copper Loss} = 0.737684 \times 1.5 \times (\text{Torque at } Avg.\ RPM/1.39)^2.$$

Note that these losses are a function of rotor speed, and more particularly the average speed during time interval (t).

$$\text{Energy Sum} = \text{Energy Sum} + \text{Incremental Energy} - \text{Bearing Loss} - \text{Core Loss} - \text{Copper Loss}$$

The looping of steps 145 and 150 allows for a determination of an actual accumulated energy required to accelerate the rotor from a first speed to a second speed. After the desired time has elapsed and the angular velocity has been attained, the method advances to steps 160, 165, 170, 175, 180 and 185 where it evaluates the six parameters in parallel.

In step 160, the method determines whether an actual accumulated energy required to accelerate the rotor from rest to a predetermined speed is within a predetermined range of an expected accumulated energy required to accelerate the rotor from rest to the predetermined speed. The method steps for evaluating the accumulated energy are described in greater detail below in association with FIG. 2. Thereafter, the method advances to step 190.

In step 165, the method determines whether an actual change in energy, i.e., energy slope, required to accelerate the rotor from a first speed to a second speed is within a predetermined range of an expected change in energy required to accelerate the rotor from the first speed to the second speed. The method steps for evaluating the energy slope are described in greater detail below in association with FIG. 3. Thereafter, the method advances to step 190.

In step 170, the method determines whether an actual energy loss due to windage of the rotor is within a predetermined range of an expected energy loss due to windage of the rotor. The determination can be made directly from a windage calculation, or alternatively, it can be based on a calculation of a drag coefficient of the rotor. The method steps for evaluating the energy loss due to windage and for evaluating the drag coefficient are described in greater detail below in association with FIGS. 4 and 4A. Thereafter, the method advances to step 190.

In step 175, the method determines whether an actual time required to accelerate the rotor from a first speed to a second speed is within a predetermined range of an expected time required to accelerate the rotor from the first speed to the second speed. The method steps for evaluating the time to accelerate from a first speed to a second speed are described in greater detail below in association with FIG. 5. Thereafter, the method advances to step 190.

In step 180, the method determines whether an actual speed of the rotor is within a predetermined range of an expected speed of the rotor at a predetermined time. The method steps for evaluating the rotor speed at the predetermined time are described in greater detail below in association with FIG. 6. Thereafter, the method advances to step 190.

In step 185, the method determines whether an actual ratio of change in acceleration and difference of drag torque speed terms of the rotor is within a predetermined range of an expected ratio of change in acceleration and difference of drag torque speed terms. The method steps for evaluating the ratio of change in acceleration and difference of drag torque speed terms are described in greater detail below in association with FIG. 7. Thereafter, the method advances to step 190.

In step 190, the method considers speed limit recommendations made during the evaluation of the six parameters in steps 160, 165, 170, 175, 180 and 185. The method allows the centrifuge rotor to continue to accelerate, subject to any speed limit that may be imposed. A method for limiting the operating speed of a centrifuge rotor where more than one parameter is considered is described in greater detail below in association with FIG. 12.

Figure 2:
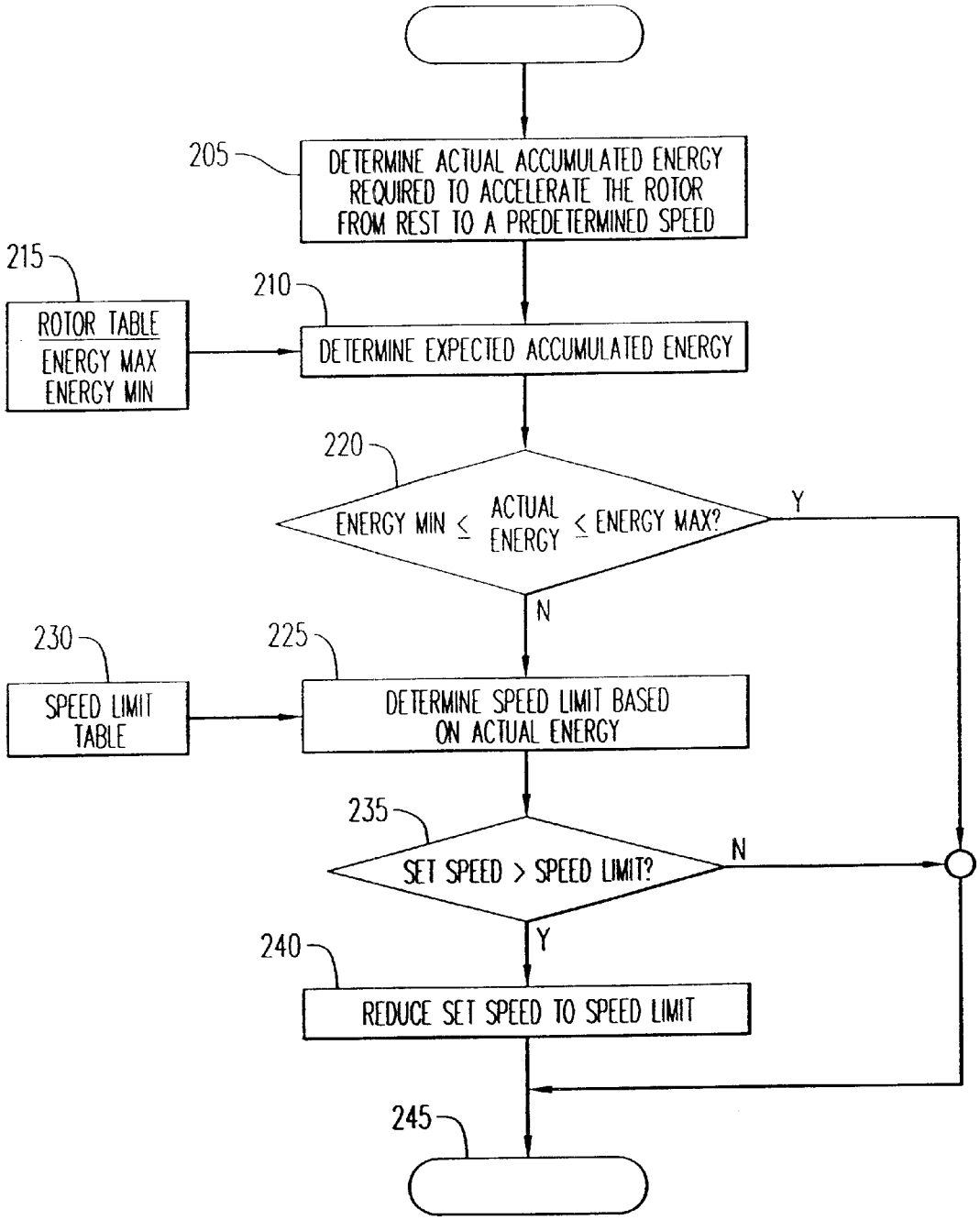
FIG. 2 is a flowchart of a method for evaluating the accumulated energy required to accelerate the rotor from rest to a predetermined speed.

FIG. 2 is a flowchart of a method for evaluating the accumulated energy required to accelerate a rotor from rest to a predetermined speed. This method is particularly effective in a case where, at the predetermined speed, resistance to torque due to windage ($\tau_{Windage}$) is an insignificant portion of the total torque applied by the motor ($\tau_{Motor}$). That is $\tau_{Windage} << \tau_{Motor}$. This flowchart together with the following narrative provides a detailed description of step 160, presented above. The method begins with step 205.

In step 205, the method determines the actual accumulated energy required to accelerate the rotor from rest to a predetermined speed. The actual accumulated energy is determined in conjunction with steps 145 and 150, described above. The method then advances to step 210.

In step 210, the method determines an expected accumulated energy required to accelerate the rotor from rest to the predetermined speed. The expected accumulated energy is obtained from a rotor table 215, which is indexed by the rotor identification obtained in step 120. Rotor table 215 indicates a minimum expected energy and a maximum expected energy to define a predetermined range for the expected accumulated energy. The method then advances to step 220.

In step 220, the method determines whether the actual accumulated energy is within the predetermined range of the expected accumulated energy, i.e., between the minimum expected energy and the maximum expected energy. If the actual accumulated energy is within the predetermined range, then the method branches to step 245. If the actual accumulated energy is not within the predetermined range, then the method advances to step 225.

In step 225, the method determines a maximum speed for the rotor based on the actual accumulated energy. The maximum speed is obtained from a speed limit table 230, which is indexed by the actual accumulated energy. The method then advances to step 235.

In step 235, the method determines whether the set speed determined in step 135 is greater than the maximum speed obtained in step 225. If the set speed is not greater than the maximum speed, then the method branches to step 245. If the set speed is greater than the maximum speed, then the method advances to step 240.

In step 240, the method reduces the set speed to the maximum speed obtained in step 225. The method then advances to step 245.

In step 245, the method for evaluating the accumulated energy required to accelerate the rotor from rest to a predetermined speed ends.

Figure 3:
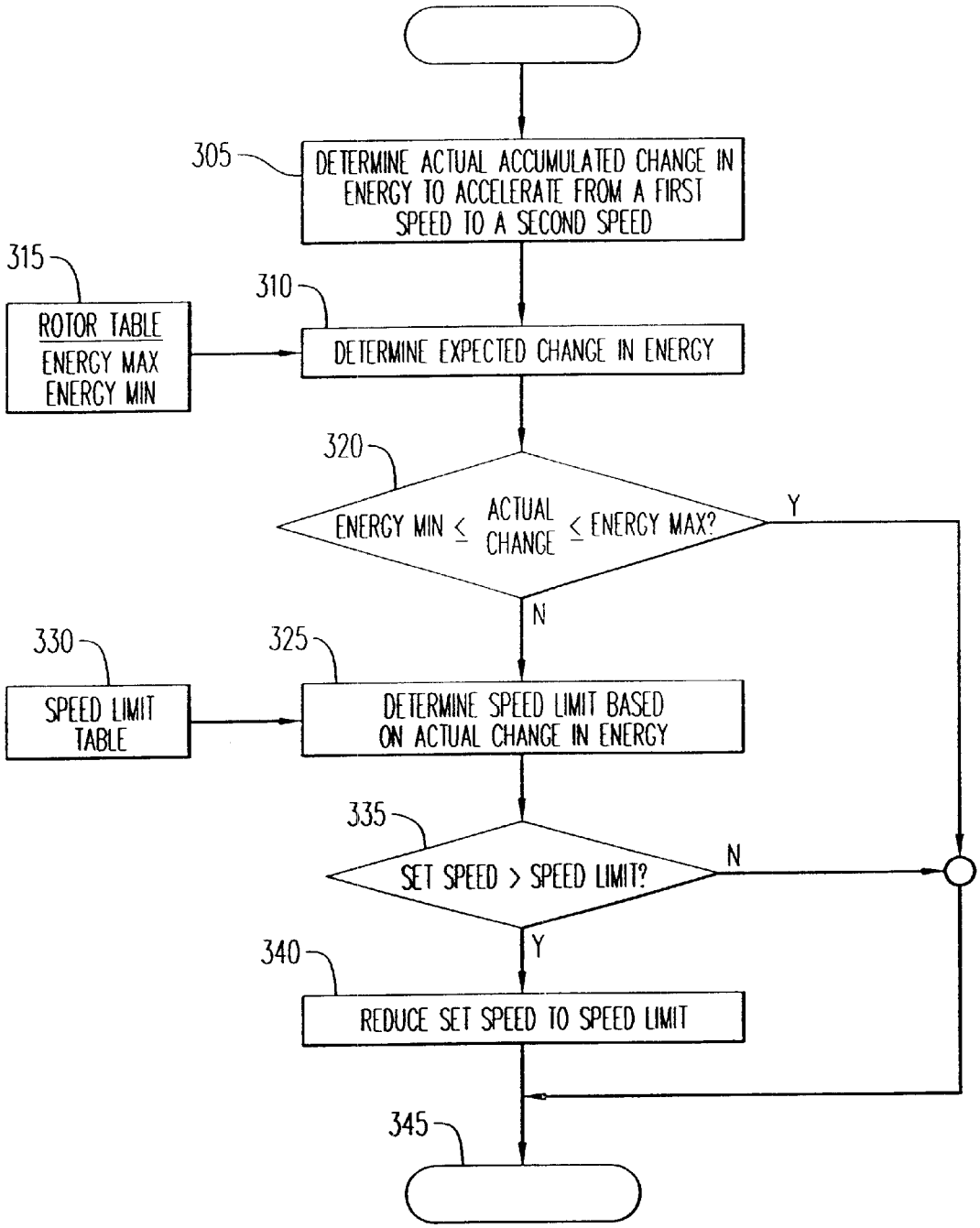
FIG. 3 is a flowchart of a method for evaluating an energy slope when accelerating a rotor from a first speed to a second speed.

FIG. 3 is a flowchart of a method for evaluating an energy slope when accelerating a rotor from a first speed to a second speed. This method determines whether an actual change in energy required to accelerate the rotor from the first speed to the second speed is within a predetermined range of an expected change in energy required to accelerate the rotor from the first speed to the second speed. This method is particularly effective in a case where, at the second speed, resistance to torque due to windage ($\tau_{Windage}$) is a significant portion of the total torque applied by the motor ($\tau_{Motor}$). This flowchart together with the following narrative provides a detailed description of step 165, presented above. The method begins with step 305.

In step 305, the method determines the actual change in accumulated energy required to accelerate the rotor from a first speed to a second speed. The actual change in accumulated energy is determined in conjunction with steps 145 and 150, described above. The method then advances to step 310.

In step 310, the method determines the expected change in accumulated energy required to accelerate the rotor from the first speed to the second speed. The expected change in accumulated energy is obtained from a rotor table 315, which is indexed by the rotor identification obtained in step 120. Rotor table 315 indicates a minimum expected change in energy and a maximum expected change in energy to define a predetermined range for the expected change in accumulated energy. The method then advances to step 320.

In step 320, the method determines whether the actual change in accumulated energy is within the predetermined range of the expected change in accumulated energy, i.e., between the minimum expected change in energy and the maximum expected change in energy. If the actual change in accumulated energy is within the predetermined range, then the method branches to step 345. If the actual change in accumulated energy is not within the predetermined range, then the method advances to step 325.

In step 325, the method determines a maximum speed for the rotor based on the actual change in accumulated energy. The maximum speed is obtained from a speed limit table 330, which is indexed by the actual change in accumulated energy. The method then advances to step 335.

In step 335, the method determines whether the set speed determined in step 135 is greater than the maximum speed obtained in step 325. If the set speed is not greater than the maximum speed, then the method branches to step 345. If the set speed is greater than the maximum speed, then the method advances to step 340.

In step 340, the method reduces the set speed to the maximum speed obtained in step 325. The method then advances to step 345.

In step 345, the method for evaluating an energy slope when accelerating a rotor from a first speed to a second speed ends.

Figure 4:
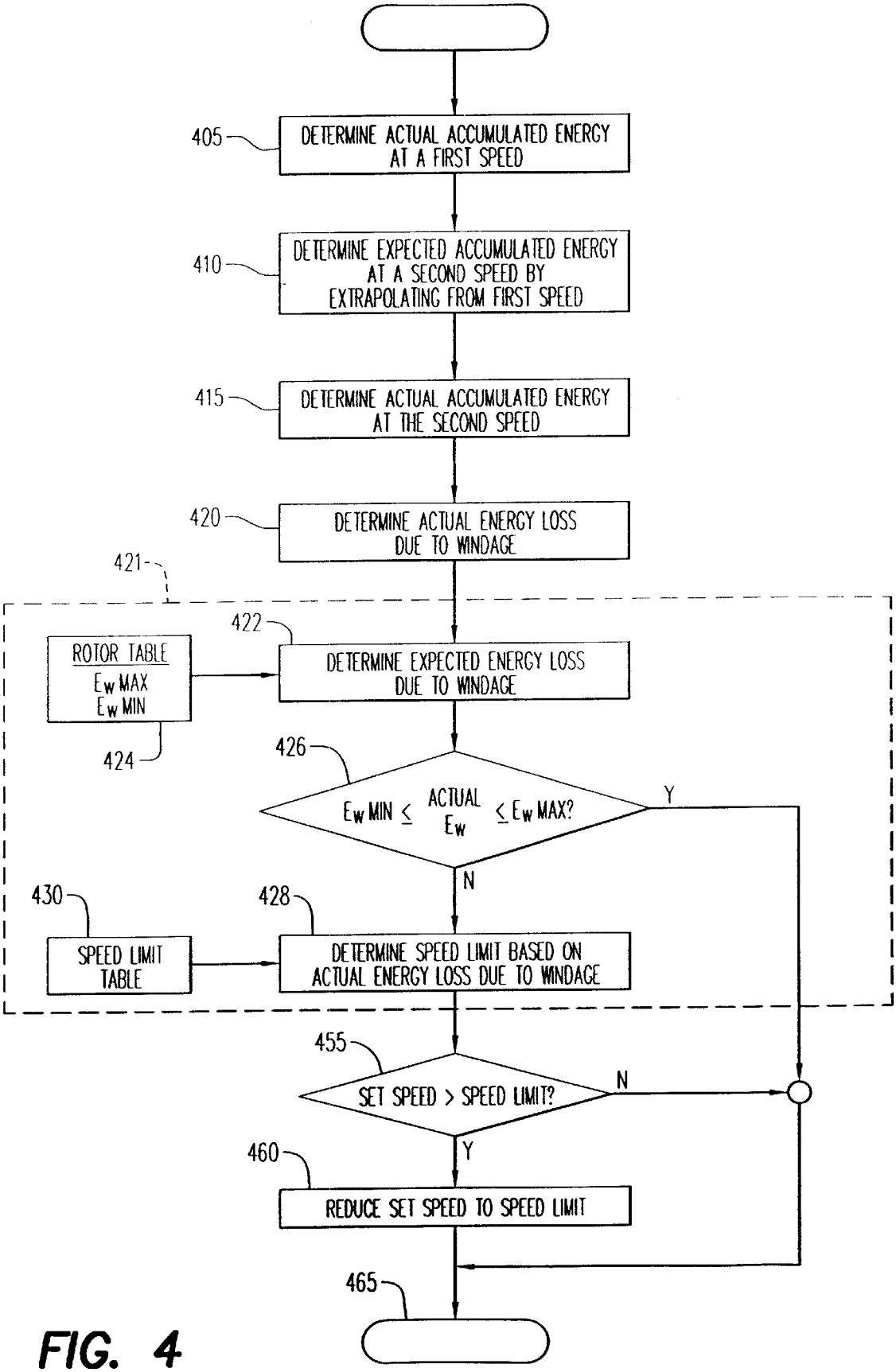
FIG. 4 is a flowchart of a method for evaluating an energy loss due to windage of a rotor.

FIG. 4 is a flowchart of a method for evaluating the energy loss due to windage of a rotor. This method determines whether an actual energy loss due to windage of the rotor is within a predetermined range of an expected energy loss due to windage of the rotor. This flowchart together with the following narrative provides a detailed description of step 170, presented above. The method begins with step 405.

In step 405, the method determines the actual accumulated energy ($E_1$) required to accelerate the rotor to a first speed ($Speed_1$). This actual accumulated energy is determined in conjunction with steps 145 and 150, described above. The method then advances to step 410.

In step 410, the method extrapolates from the result obtained in step 405, to determine an expected accumulated energy ($EE_2$) required to accelerate the rotor to a second speed ($Speed_2$).

$$EE_2 = E_1 \times (\text{Speed}_2)^2/(\text{Speed}_1)^2$$

The method then advances to step 415.

In step 415, the method determines an actual accumulated energy required to accelerate the rotor to the second speed. This actual accumulated energy is determined in conjunction with steps 145 and 150, described above. The method then advances to step 420.

In step 420, the method determines an actual energy loss due to windage ($E_w$). The actual energy loss due to windage ($E_w$) is a difference between the expected accumulated energy at the second speed, from step 410, and the actual accumulated energy at the second speed, from step 415. The method then advances to step 422.

In step 422, the method determines an expected energy loss due to windage of the rotor. The expected energy loss due to windage is obtained from a rotor table 424, which is indexed by the rotor identification obtained in step 120. Rotor table 424 indicates a minimum expected energy loss due to windage and a maximum expected energy loss due to windage to define a predetermined range for the expected energy loss due to windage. The method then advances to step 426.

In step 426, the method determines whether the actual energy loss due to windage is within the predetermined range of the expected energy loss due to windage, i.e., between the minimum expected energy loss due to windage and the maximum expected energy loss due to windage. If the actual energy loss due to windage is within the predetermined range, then the method branches to step 465. If the actual energy loss due to windage is not within the predetermined range, then the method advances to step 428.

In step 428, the method determines a maximum speed for the rotor based on the actual energy loss due to windage. The maximum speed is obtained from a speed limit table 430, which is indexed by the actual energy loss due to windage. The method then advances to step 455.

In step 455, the method determines whether the set speed determined in step 135 is greater than the maximum speed obtained in step 428. If the set speed is not greater than the maximum speed, then the method branches to step 465. If the set speed is greater than the maximum speed, then the method advances to step 460.

In step 460, the method reduces the set speed to the speed limit obtained in step 445. The method then advances to step 465.

In step 465, the method for evaluating the drag coefficient of a rotor ends.

Figure 4A:
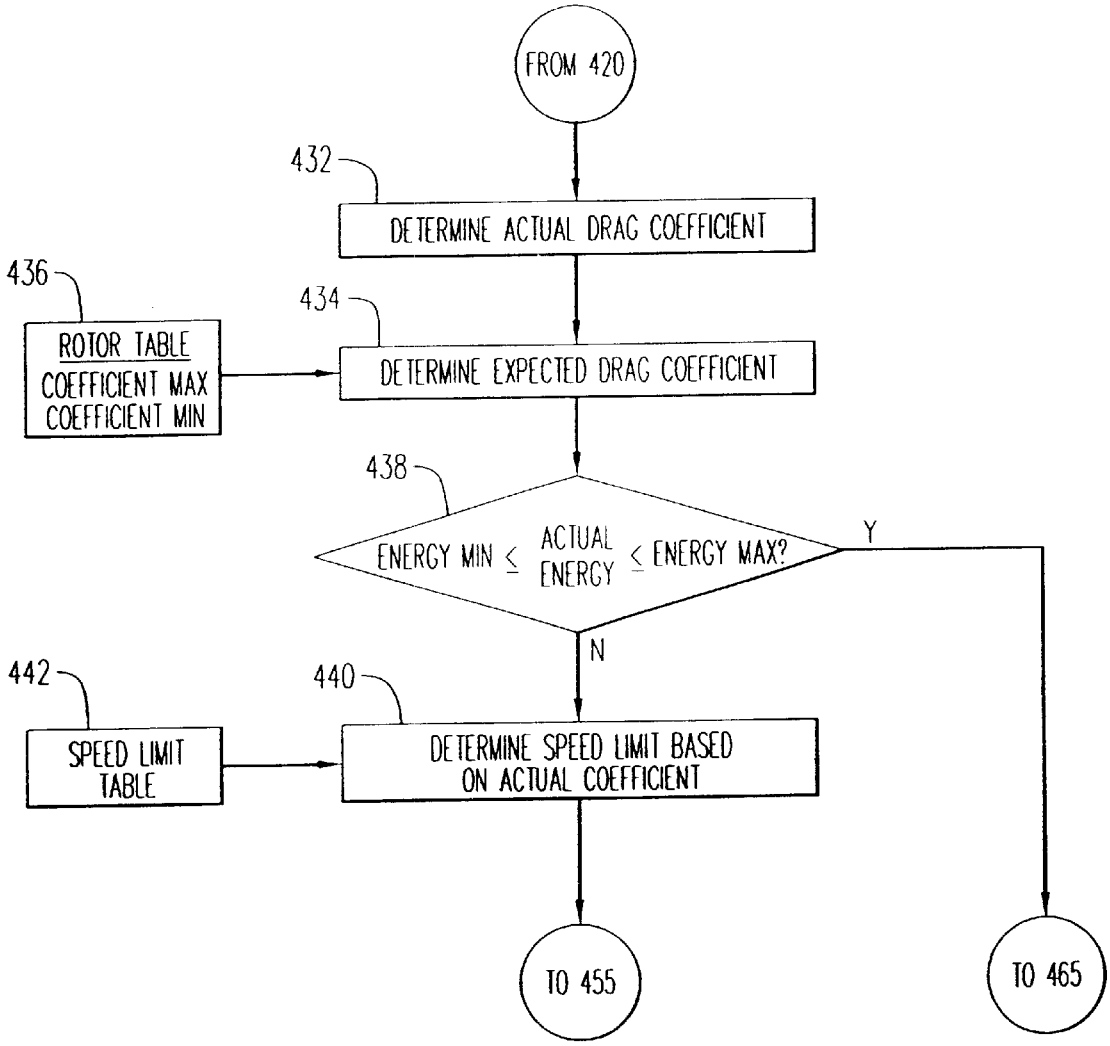
FIG. 4A is a flowchart of a method for evaluating a drag coefficient of a rotor.

FIG. 4A is a flowchart of a method for evaluating a drag coefficient of the rotor. Note that in FIG. 4, steps 422 through 428, inclusive, are bounded by dashed line 421. The method shown in FIG. 4A can be performed as an alternative to steps 422 through 428. This alternative method is entered from step 420, and begins with step 432.

In step 432, the method determines an actual drag coefficient for the rotor ($C_a$). The actual drag coefficient for the rotor ($C_a$) is a function of the second speed ($Speed_2$) from step 410, and the actual energy loss due to windage ($E_w$) from step 420. The actual drag coefficient for the rotor ($C_a$) can be represented by the formula:

$$C_a=(\text{Speed}_2/1000)^{1.8}/E_w$$

The method then advances to step 434.

In step 434, the method determines an expected drag coefficient for the rotor. The expected drag coefficient is obtained from a rotor table 436, which is indexed by the rotor identification obtained in step 120. Rotor table 436 indicates a minimum expected drag coefficient and a maximum expected drag coefficient to define a predetermined range for the expected drag coefficient. The method then advances to step 438.

In step 438, the method determines whether the actual drag coefficient is within the predetermined range of the expected drag coefficient, i.e., between the minimum expected drag coefficient and the maximum expected drag coefficient. If the actual drag coefficient is within the predetermined range, then the method branches to step 465. If the actual drag coefficient is not within the predetermined range, then the method advances to step 440.

In step 440, the method determines a maximum speed for the rotor based on the actual drag coefficient. The maximum speed is obtained from a speed limit table 442, which is indexed by the actual drag coefficient. The method then advances to step 455.

Figure 5:
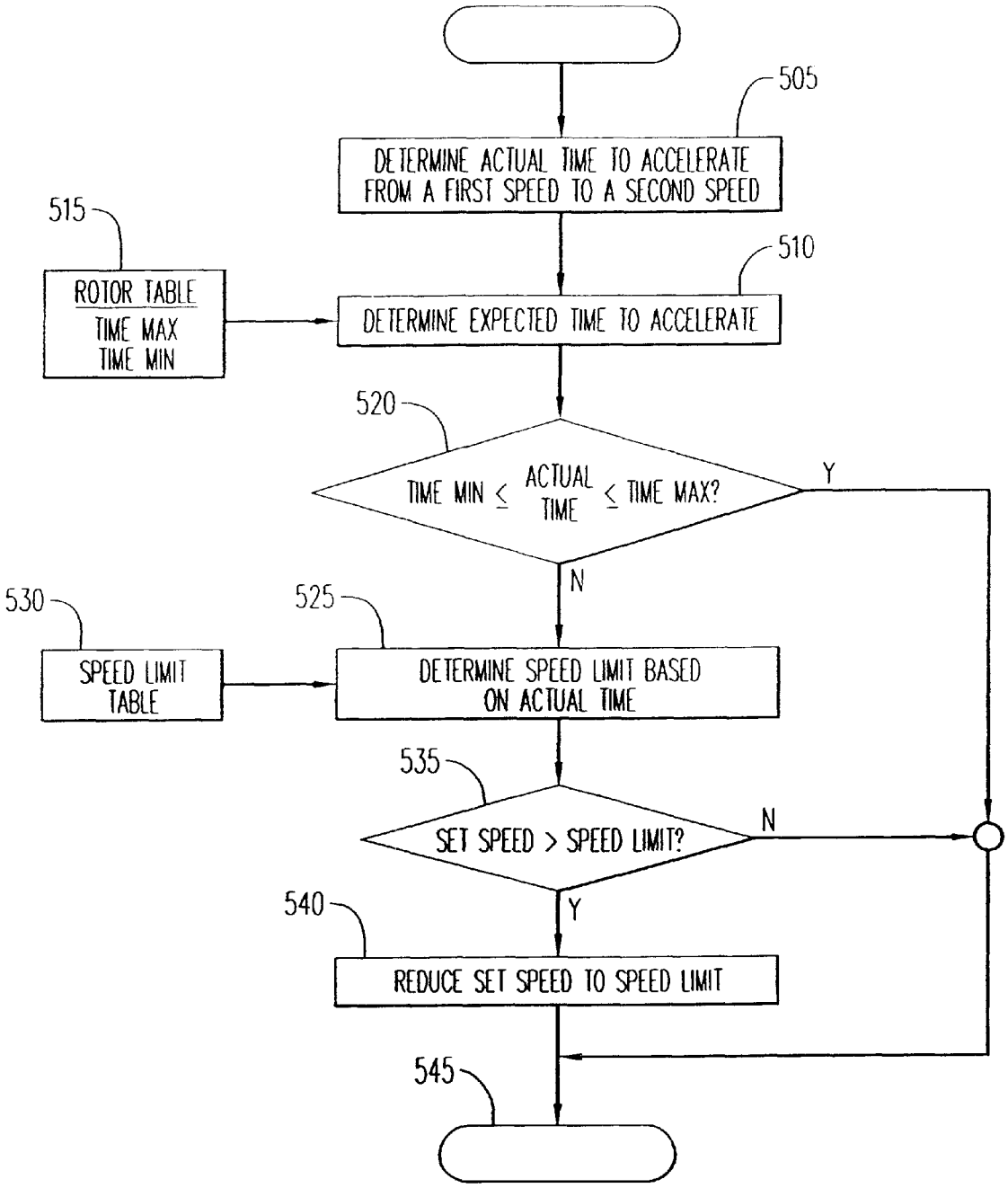
FIG. 5 is a flowchart of a method for evaluating a time to accelerate a rotor from a first speed to a second speed.

FIG. 5 is a flowchart of a method for evaluating a time to accelerate a rotor from a first speed to a second speed. This method determines whether an actual time required to accelerate the rotor from the first speed to the second speed is within a predetermined range of an expected time required to accelerate the rotor from the first speed to the second speed. This flowchart together with the following narrative provides a detailed description of step 175, presented above. The method begins with step 505.

In step 505, the method determines the actual time required to accelerate the rotor from a first speed to a second speed. The actual time required is determined in conjunction with step 145, described above. The method then advances to step 510.

In step 510, the method determines an expected time required to accelerate the rotor from the first speed to the second speed. The expected time required to accelerate is obtained from a rotor table 515, which is indexed by the rotor identification obtained in step 120. Rotor table 515 indicates a minimum expected time and a maximum expected time to define a predetermined range for the expected time required to accelerate from the first speed to the second speed. The method then advances to step 520.

In step 520, the method determines whether the actual time required to accelerate is within the predetermined range of the expected time required to accelerate, i.e., between the minimum expected time and the maximum expected time. If the actual time required to accelerate is within the predetermined range, then the method branches to step 545. If the actual time required to accelerate is not within the predetermined range, then the method advances to step 525.

In step 525, the method determines a maximum speed for the rotor based on the actual time required to accelerate from the first speed to the second speed. The maximum speed is obtained from a speed limit table 530, which is indexed by the actual time required to accelerate. The method then advances to step 535.

In step 535, the method determines whether the set speed determined in step 135 is greater than the maximum speed obtained in step 525. If the set speed is not greater than the maximum speed, then the method branches to step 545. If the set speed is greater than the maximum speed, then the method advances to step 540.

In step 540, the method reduces the set speed to the maximum speed obtained in step 525. The method then advances to step 545.

In step 545, the method for evaluating the time required to accelerate the rotor from the first speed to the second speed ends.

Figure 6:
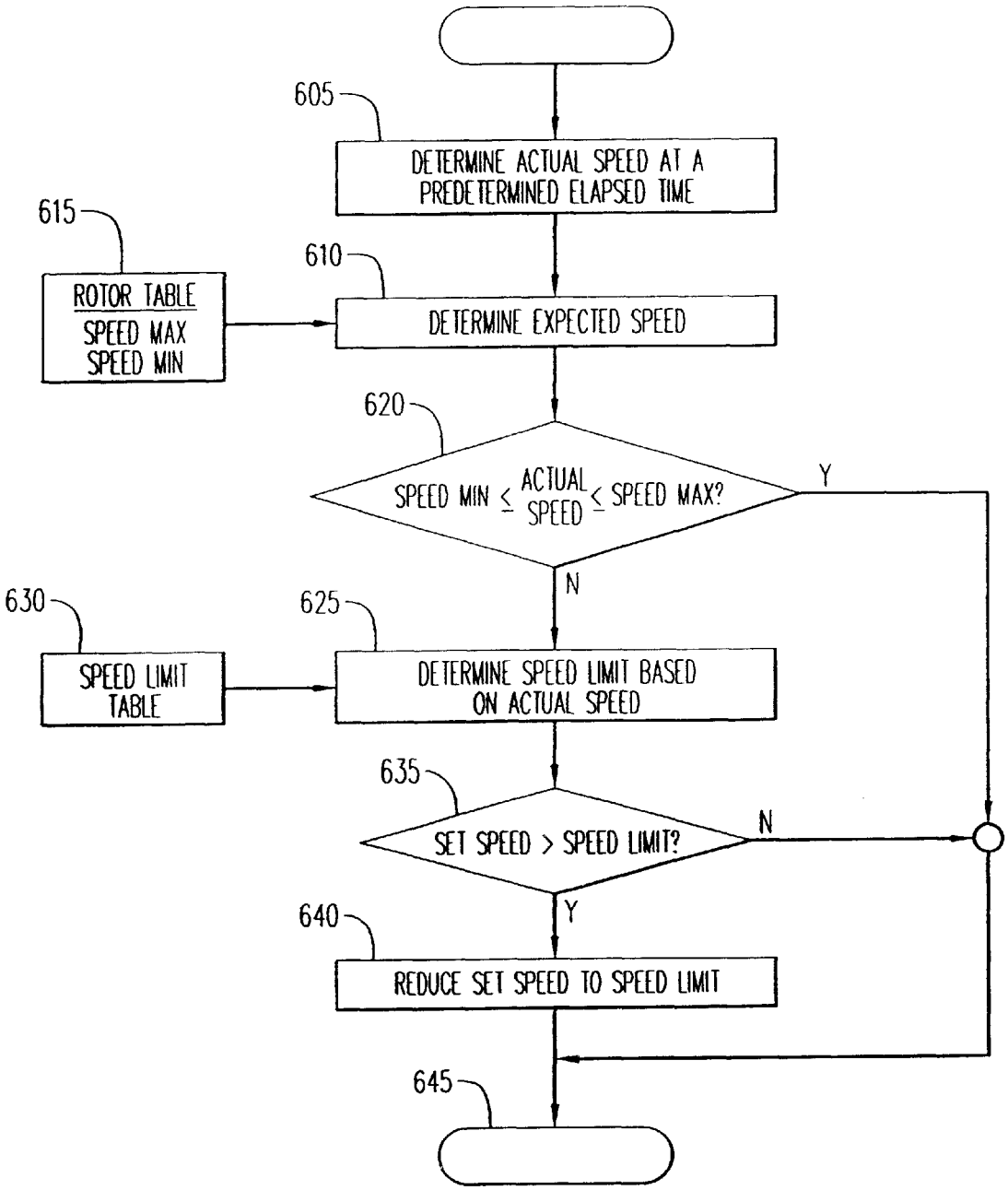
FIG. 6 is a flowchart of a method for evaluating a rotor speed at a predetermined time.

FIG. 6 is a flowchart of a method for evaluating a rotor speed at a predetermined time. This method determines whether an actual speed of the rotor is within a predetermined range of an expected speed of the rotor at the predetermined time. This flowchart together with the following narrative provides a detailed description of step 180, presented above. The method begins with step 605.

In step 605, the method determines the actual speed of the rotor at a predetermined elapsed time. The actual speed is determined in conjunction with step 145, described above. The method then advances to step 610.

In step 610, the method determines an expected speed at the predetermined elapsed time. The expected speed is obtained from a rotor table 615, which is indexed by the rotor identification obtained in step 120. Rotor table 615 indicates a minimum expected speed and a maximum expected speed to define a predetermined range for the expected speed. The method then advances to step 620.

In step 620, the method determines whether the actual speed is within the predetermined range of the expected speed, i.e., between the minimum expected speed and the maximum expected speed. If the actual speed is within the predetermined range, then the method branches to step 645. If the actual speed is not within the predetermined range, then the method advances to step 625.

In step 625, the method determines a maximum speed for the rotor based on the actual speed. The maximum speed is obtained from a speed limit table 630, which is indexed by the actual speed. The method then advances to step 635.

In step 635, the method determines whether the set speed determined in step 135 is greater than the maximum speed obtained in step 625. If the set speed is not greater than the maximum speed, then the method branches to step 645. If the set speed is greater than the maximum speed, then the method advances to step 640.

In step 640, the method reduces the set speed to the maximum speed obtained in step 625. The method then advances to step 645.

In step 645, the method for evaluating the rotor speed at a predetermined time ends.

FIGS. 7 through 10 are flowcharts of methods that either directly or indirectly exploit a ratio of change in acceleration and difference of drag torque speed terms. The ratio of interest includes a term representing a change in acceleration, $$(drpm_2/dt_2)-(drpm_1/dt_1)$$

and a term representing a difference of drag torque speed terms, $$(rpm_1/1000)1.8-(rpm_2/1000)^{1.8}$$

The ratio can be evaluated as either $$\frac{\text{change in acceleration}}{\text{difference of drag torque speed terms}} \text{ or } \frac{\text{difference of drag torque speed terms}}{\text{change in acceleration}}.$$

The following paragraphs set forth the theoretical basis for using the ratio, and then describe the steps employed to execute the methods illustrated in FIGS. 7 through 10.

When a motor rotates a rotor, rotor inertia and windage, that is drag, offer resistance to a torque applied by the motor. Accordingly, torque applied by the motor ($\tau_{Motor}$) is equal to resistance to torque due to inertia ($\tau_{Inertia}$) plus resistance to torque due to windage ($\tau_{Windage}$).

$$\tau_{Motor}=\tau_{Inertia}+\tau_{Windage}$$

$$\tau_{Inertia}=I(d\omega/dt)$$

$$\tau_{Windage}=C_d(rpm/1000)^{1.8}$$

where:

rpm=rotor speed {revolutions per minute}

I=inertia {inch lb sec$^2$}

$\omega=(2\pi/60)\times(rpm)$ {radians per second}

$(d\omega/dt)$=differential acceleration of the rotor $C_d$=rotor drag coefficient Therefore, $$\tau_{Motor}=I(d\omega/dt)+C_d(rpm/1000)^{1.8}$$

Over an interval of time when accelerating from a first speed ($rpm_1$) to a second speed ($rpm_2$) where motor torque is constant:

$$I(d\omega_1/dt_1)+C_d(rpm_1/1000)^{1.8}=I(d\omega_2/dt_2)+C_d(rpm_2/1000)^{1.8}$$

$$C_d = \frac{2\pi I[(drpm_2/dt_2)-(drpm_1/dt_1)]}{60[(rpm_1/1000)^{1.8}-(rpm_2/1000)^{1.8}]}$$

-continued $$C_d/I = \frac{2\pi[(drpm_2/dt_2)-(drpm_1/dt_1)]}{60[(rpm_1/1000)^{1.8}-(rpm_2/1000)^{1.8}]}$$

$$C_d/I = \frac{2\pi[(rpm_{2_2}-rpm_{2_1})/(time_{2_2}-time_{2_1})-(rpm_{1_2}-rpm_{1_1})/(time_{1_2}-time_{1_1})]}{60[(rpm_1/1000)^{1.8}-(rpm_2/1000)^{1.8}]}$$

where:

$rpm_{1_1}$=rotor speed marginally below $rpm_1$ $time_{1_1}$=time at which $rpm_{1_1}$ occurred $rpm_{1_2}$=rotor speed marginally above $rpm_1$ $time_{1_2}$=time at which $rpm_{1_2}$ occurred $rpm_{2_1}$=rotor speed marginally below $rpm_2$ $time_{2_1}$=time at which $rpm_{2_1}$ occurred $rpm_{2_2}$=rotor speed marginally above $rpm_2$ $time_{2_2}$=time at which $rpm_{2_2}$ occurred Thus, a ratio of change in acceleration and difference of drag torque speed terms can be derived from four discrete speed measurements, and four discrete time measurements. Note that this ratio is equivalent to a ratio of drag coefficient ($C_d$) and inertia (I), and that the ratio of drag coefficient ($C_d$) and inertia (I) can be found without explicitly measuring or determining either $C_d$ or I. Furthermore, given drag coefficient ($C_d$), inertia (I) can be calculated, and given inertia (I), drag coefficient ($C_d$) can be calculated.

Figure 7:
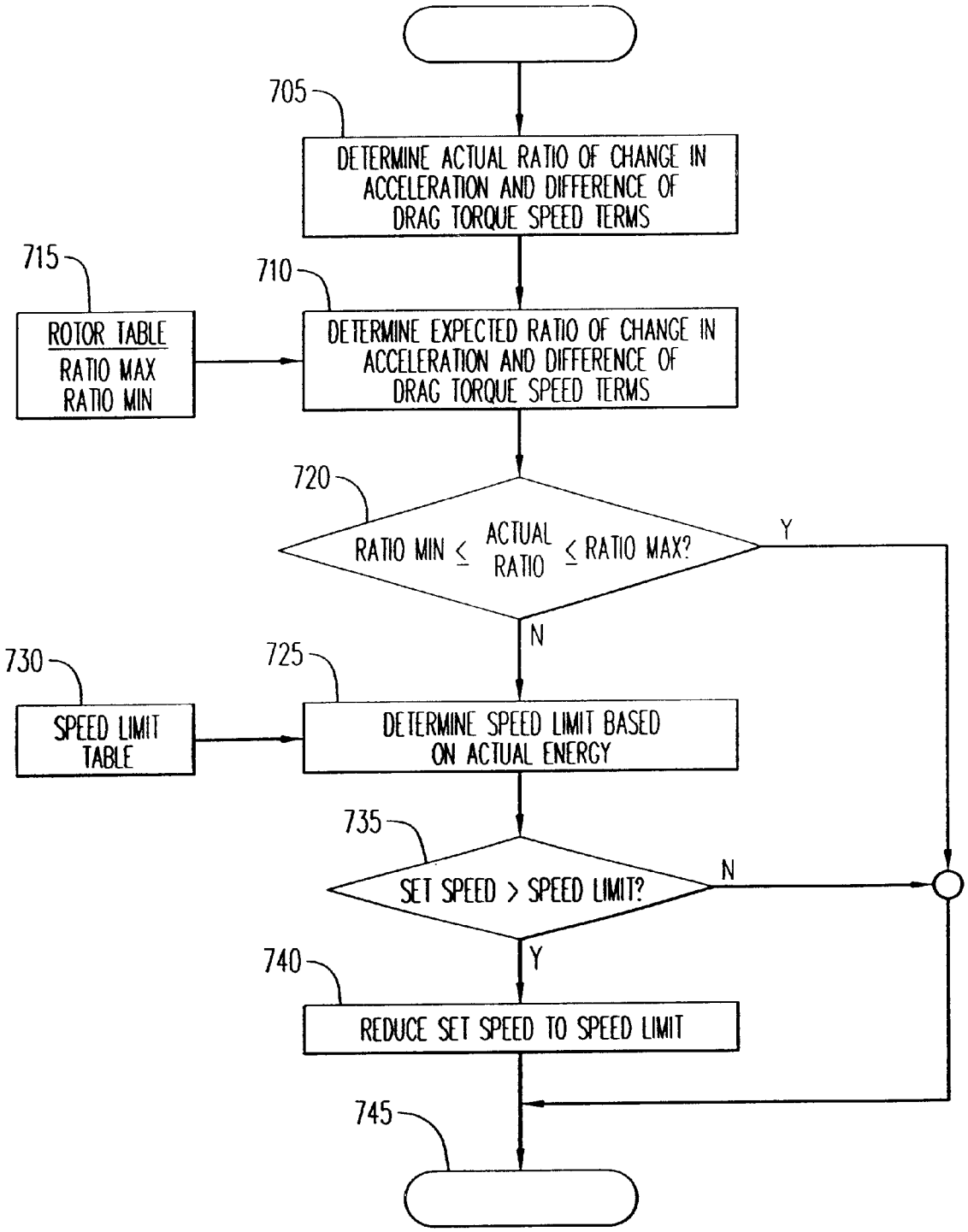
FIG. 7 is a flowchart of a method for evaluating a ratio of change in acceleration and difference of drag torque speed terms.

FIG. 7 is a flowchart of a method for evaluating a ratio of change in acceleration and difference of drag torque speed terms of a rotor. This method determines whether an actual ratio of change in acceleration and difference of drag torque speed terms is within a predetermined range of an expected ratio of change in acceleration and difference of drag torque speed terms. This flowchart together with the following narrative provides a detailed description of step 185, presented above. The method begins with step 705.

In step 705, the method determines the actual ratio of change in acceleration and difference of drag torque speed terms. As described above, this step includes determining a first differential acceleration ($drpm_1/dt_1$) for a first speed ($rpm_1$), and determining a second differential acceleration ($drpm_2/dt_2$) for a second speed ($rpm_2$) from four discrete speed measurements, and four discrete time measurements.

$$\frac{2\pi[(drpm_2/dt_2)-(drpm_1/dt_1)]}{60[(rpm_1/1000)^{1.8}-(rpm_2/1000)^{1.8}]}$$

$$\frac{2\pi[(rpm_{2_2}-rpm_{2_1})/(time_{2_2}-time_{2_1})-(rpm_{1_2}-rpm_{1_1})/(time_{1_2}-time_{1_1})]}{60[(rpm_1/1000)^{1.8}-(rpm_2/1000)^{1.8}]}$$

The method then advances to step 710.

In step 710, the method determines an expected ratio of change in acceleration and difference of drag torque speed terms. The expected ratio is obtained from a rotor table 715, which is indexed by the rotor identification obtained in step 120. Rotor table 715 indicates a minimum expected value for the ratio and a maximum expected value for the ratio to define a predetermined range for the expected ratio. The method then advances to step 720.

In step 720, the method determines whether the actual ratio is within the predetermined range of the expected ratio, i.e., between the minimum expected ratio and the maximum expected ratio. If the actual ratio is within the predetermined range, then the method branches to step 745. If the actual ratio is not within the predetermined range, then the method advances to step 725.

In step 725, the method determines a maximum speed for the rotor based on the actual ratio. The maximum speed is obtained from a speed limit table 730, which is indexed by the value of the actual ratio. The method then advances to step 735.

In step 735, the method determines whether the set speed determined in step 135 is greater than the maximum speed obtained in step 725. If the set speed is not greater than the maximum speed, then the method branches to step 745. If the set speed is greater than the maximum speed, then the method branches to step 740.

In step 740, the method reduces the set speed to the maximum speed obtained in step 725. The method then advances to step 745.

In step 745, the method for evaluating the ratio of change in acceleration and difference of drag torque speed terms ends.

Figure 8:
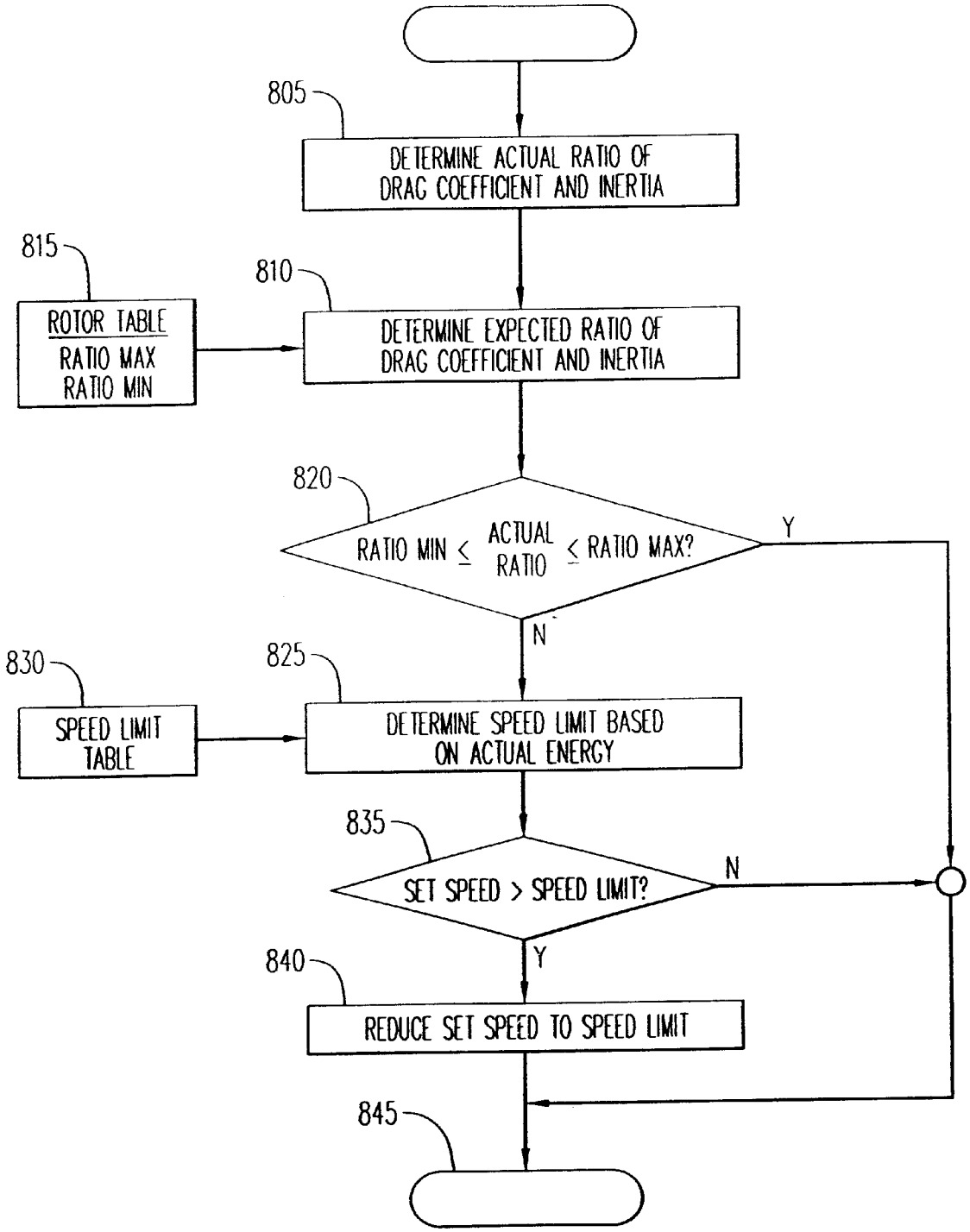
FIG. 8 is a flowchart of a method for evaluating a ratio of drag coefficient and inertia of a rotor.

FIG. 8 is a flowchart of a method for evaluating a ratio of drag coefficient and inertia of a rotor. This method, which is a refinement of the method illustrated in FIG. 7, determines whether an actual ratio of drag coefficient and inertia of the rotor is within a predetermined range of an expected ratio of drag coefficient and inertia. The method illustrated in FIG. 8 begins with step 805.

In step 805, the method determines the actual ratio of drag coefficient ($C_d$) and inertia (I). The actual ratio can be directly calculated from an actual drag coefficient ($C_d$) and an actual inertia (I), or indirectly calculated from a ratio of change in acceleration and difference of drag torque speed terms, as described above. When using the ratio of change in acceleration and difference of drag torque speed terms this step includes determining a first differential acceleration ($drpm_1/dt_1$) for a first speed ($rpm_1$), and determining a second differential acceleration ($drpm_2/dt_2$) for a second speed ($rpm_2$) from four discrete speed measurements, and four discrete time measurements.

$$C_d/I = \frac{2\pi[(drpm_2/dt_2) - (drpm_1/dt_1)]}{60[(rpm_1/1000)^{1.8} - (rpm_2/1000)^{1.8}]}$$

$$C_d/I = \frac{2\pi\left[\left(rpm_{2_2} - rpm_{2_1}\right)/(time_{2_2} - time_{2_1}) - \left(rpm_{1_2} - rpm_{1_1}\right)/(time_{1_2} - time_{1_1})\right]}{60[(rpm_1/1000)^{1.8} - (rpm_2/1000)^{1.8}]}$$

The method then advances to step 810.

In step 810, the method determines an expected ratio of drag coefficient and inertia. The expected ratio is obtained from a rotor table 815, which is indexed by the rotor identification obtained in step 120. Rotor table 815 indicates a minimum expected value for the ratio and a maximum expected value for the ratio to define a predetermined range for the expected ratio. The method then advances to step 820.

In step 820, the method determines whether the actual ratio is within the predetermined range of the expected ratio, i.e., between the minimum expected ratio and the maximum expected ratio. If the actual ratio is within the predetermined range, then the method branches to step 845. If the actual ratio is not within the predetermined range, then the method advances to step 825.

In step 825, the method determines a maximum speed for the rotor based on the actual ratio. The maximum speed is obtained from a speed limit table 830, which is indexed by the value of the actual ratio. The method then advances to step 835.

In step 835, the method determines whether the set speed determined in step 135is greater than the maximum speed obtained in step 825. If the set speed is not greater than the maximum speed, then the method branches to step 845. If the set speed is greater than the maximum speed, then the method branches to step 840.

In step 840, the method reduces the set speed to the maximum speed obtained in step 825. The method then advances to step 845.

In step 845, the method for evaluating the ratio of drag coefficient and inertia ends.

Figure 9:
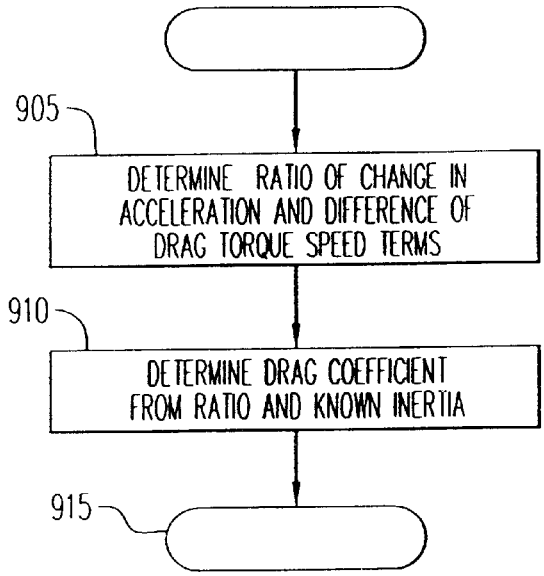
FIG. 9 is a flowchart of a method for determining a drag coefficient of a centrifuge rotor.

FIG. 9 is a flowchart of a method for determining a drag coefficient ($C_d$) of a centrifuge rotor. This method determines the drag coefficient ($C_d$) from an equation that uses an inertia (I) of the rotor and a ratio of change in acceleration and difference of drag torque speed terms. The method begins with step 905.

In step 905, the method determines a ratio of change in acceleration and difference of drag torque speed terms. The determination of the ratio of change in acceleration and difference of drag torque speed terms includes determining a first differential acceleration ($drpm_1/dt_1$) for a first speed ($rpm_1$), and determining a second differential acceleration ($drpm_2/dt_2$) for a second speed ($rpm_2$) from four discrete speed measurements, and four discrete time measurements.

$$C_d/I = \frac{2\pi[(drpm_2/dt_2) - (drpm_1/dt_1)]}{60[(rpm_1/1000)^{1.8} - (rpm_2/1000)^{1.8}]}$$

$$C_d/I = \frac{2\pi\left[\left(rpm_{2_2} - rpm_{2_1}\right)/(time_{2_2} - time_{2_1}) - \left(rpm_{1_2} - rpm_{1_1}\right)/(time_{1_2} - time_{1_1})\right]}{60[(rpm_1/1000)^{1.8} - (rpm_2/1000)^{1.8}]}$$

The method then advances to step 910.

In step 910, the method calculates the drag coefficient ($C_d$) from the ratio and the inertia (I).

$$C_d = \frac{2\pi I[(drpm_2/dt_2) - (drpm_1/dt_1)]}{60[(rpm_1/1000)^{1.8} - (rpm_2/1000)^{1.8}]}$$

$$C_d = \frac{2\pi I\left[\left(rpm_{2_2} - rpm_{2_1}\right)/(time_{2_2} - time_{2_1}) - \left(rpm_{1_2} - rpm_{1_1}\right)/(time_{1_2} - time_{1_1})\right]}{60[(rpm_1/1000)^{1.8} - (rpm_2/1000)^{1.8}]}$$

The method then advances to step 915.

In step 915, the method for determining a drag coefficient ($C_d$) of a centrifuge rotor ends.

Figure 10:
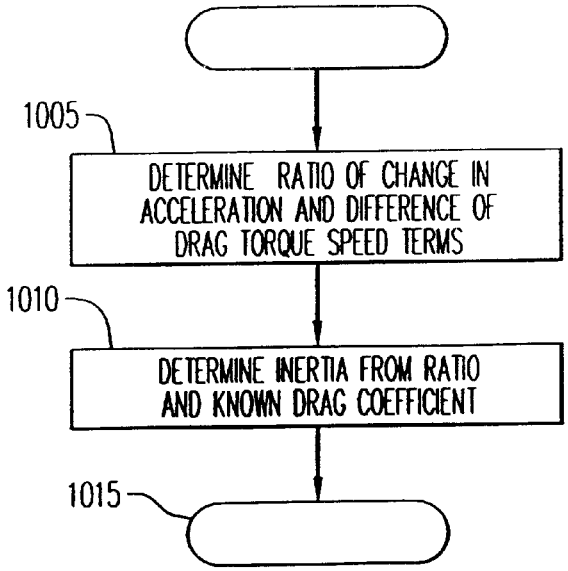
FIG. 10 is a flowchart of a method for determining inertia of a centrifuge rotor.

FIG. 10 is a flowchart of a method for determining an inertia (I) of a centrifuge rotor. This method determines the inertia (I) from an equation that uses a drag coefficient ($C_d$) of the rotor and a ratio of change in acceleration and difference of drag torque speed terms. The method begins with step 1005.

In step 1005, the method determines a ratio of change in acceleration and difference of drag torque speed terms. The determination of the ratio of change in acceleration and difference of drag torque speed terms includes determining a first differential acceleration ($drpm_1/dt_1$) for a first speed ($rpm_1$), and determining a second differential acceleration ($drpm_2/dt_2$) for a second speed ($rpm_2$) from four discrete speed measurements, and four discrete time measurements.

$$C_d / I = \frac{2\pi[(d rpm_2 / dt_2) - (d rpm_1 / dt_1)]}{60[(rpm_1 / 1000)^{1.8} - (rpm_2 / 1000)^{1.8}]}$$

$$C_d / I = \frac{2\pi\left[\left(rpm_{2_2} - rpm_{2_1}\right) / (time_{2_2} - time_{2_1}) - \left(rpm_{1_2} - rpm_{1_1}\right) / (time_{1_2} - time_{1_1})\right]}{60[(rpm_1 / 1000)^{1.8} - (rpm_2 / 1000)^{1.8}]}$$

The method then advances to step 1010.

In step 1010, the method calculates the inertia (I) from the ratio and the drag coefficient ($C_d$).

$$I = \frac{60 C_d[(rpm_1 / 1000)^{1.8} - (rpm_2 / 1000)^{1.8}]}{2\pi[(d rpm_2 / dt_2) - (d rpm_1 / dt_1)]}$$

$$I = \frac{60 C_d[(rpm_1 / 1000)^{1.8} - (rpm_2 / 1000)^{1.8}]}{2\pi\left[\left(rpm_{2_2} - rpm_{2_1}\right) / (time_{2_2} - time_{2_1}) - \left(rpm_{1_2} - rpm_{1_1}\right) / (time_{1_2} - time_{1_1})\right]}$$

The method then advances to step 1015.

In step 1015, the method for determining an inertia (I) of a centrifuge rotor ends.

Figure 11:
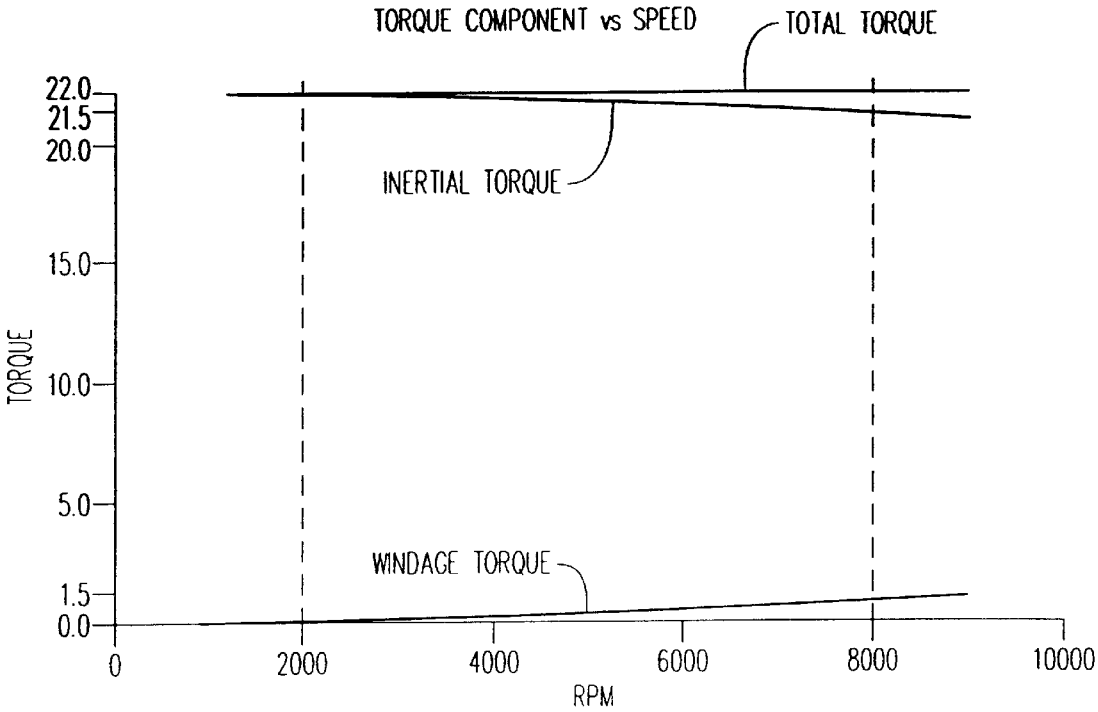
FIG. 11 is a graph showing a general relationship between windage torque and inertial torque as a function of rotor speed for a hypothetical rotor.

Referring again to FIG. 1, steps 160 through 185, inclusive, are represented as evaluating the six parameters in parallel, and thereafter step 190 considers speed limit recommendations made during the evaluation of the six parameters. This process of evaluating multiple parameters provides an additional degree of safety and certainty. Also, in a particular situation, one of the various methods may be better suited than the other methods to determine a safe operating speed. For example, the graph in FIG. 11 shows a general relationship between windage torque and inertial torque as a function of rotor speed for a hypothetical rotor. Note that as rotor speed increases, windage torque increases and inertial torque decreases. Accordingly, the method for evaluating the accumulated energy required to accelerate the rotor from rest to a predetermined speed is more effective at lower speeds, and the method for evaluating an energy loss due to windage of a rotor is more effective at higher speeds.

Figure 12:
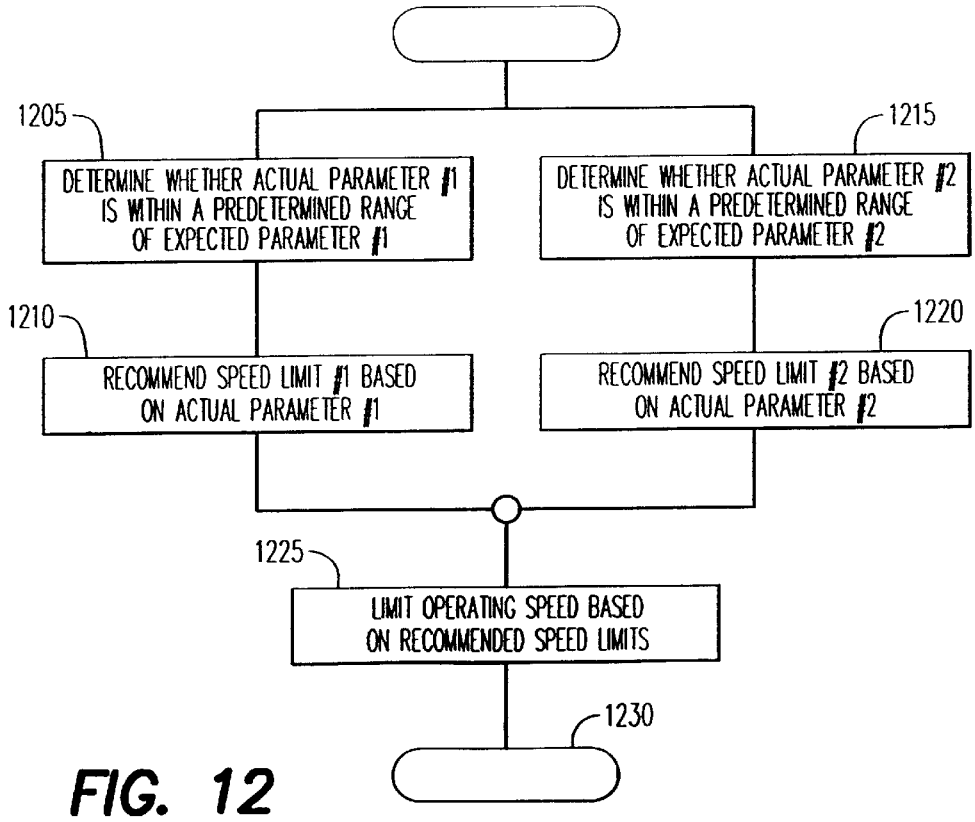
FIG. 12 is a flowchart of a method for limiting the operating speed of a centrifuge rotor where more than one parameter is evaluated.

FIG. 12 is a flowchart of a method for limiting the operating speed of a centrifuge rotor where more than one parameter is evaluated. Generally, steps 1205 and 1210 represent an evaluation of a first parameter, and in parallel, steps 1215 and 1220 represent an evaluation of a second parameter. Note however that the invention is capable of evaluating any number of parameters. The method begins with steps 1205 and 1215.

In step 1205, the method determines whether a first actual parameter is within a predetermined range of a first expected parameter. The method then advances to step 1210.

In step 1210, the method recommends a first speed limit based on the determination made in step 1205. For example, if the first actual parameter is within the predetermined range, then step 1210 recommends a first speed limit that is the same as a user-selected set speed, i.e., no reduction in speed. However, if the first actual parameter is not within the predetermined range, then step 1210 recommends a first speed limit that is less than the user-selected speed. The method then advances to step 1225.

In step 1215, the method determines whether a second actual parameter is within a predetermined range of a second expected parameter. The method then advances to step 1220.

In step 1220, the method recommends a second speed limit based on the determination made in step 1215. For example, if the second actual parameter is within the predetermined range, then step 1220 recommends a second speed limit that is the same as a user-selected set speed, i.e., no reduction in speed. However, if the second actual parameter is not within the predetermined range, then step 1220 recommends a second speed limit that is less than the user-selected speed. The method then advances to step 1225.

In step 1225, the method considers the recommendations provided by steps 1210 and 1220, and limits the operating speed based on the recommendations. For example, if both steps 1210 and 1220 recommend a speed limit that is the same as the user-selected set speed, then step 1225 limits the operating speed to the user-selected set speed. If either of step 1210 or 1220 recommend a reduced speed limit, then step 1225 limits the operating speed to the lowest recommended value.

Step 1225 can apply complex rules when considering the recommended speed limits. For example, it may consider the speed at which the rotor was revolving when the parameters were evaluated in steps 1205 and 1215, and then weigh the recommendations based on the effectiveness of each method at that speed. As stated above, the method for evaluating the accumulated energy required to accelerate the rotor from rest to a predetermined speed is more effective at lower speeds, so accordingly, at low speeds, a recommendation from this method may have more weight than a recommendation from one of the other methods. After execution of step 1225, the present method advances to step 1230.

In step 1230, the method for limiting the operating speed of a centrifuge rotor where more than one parameter is evaluated ends.

Figure 13:
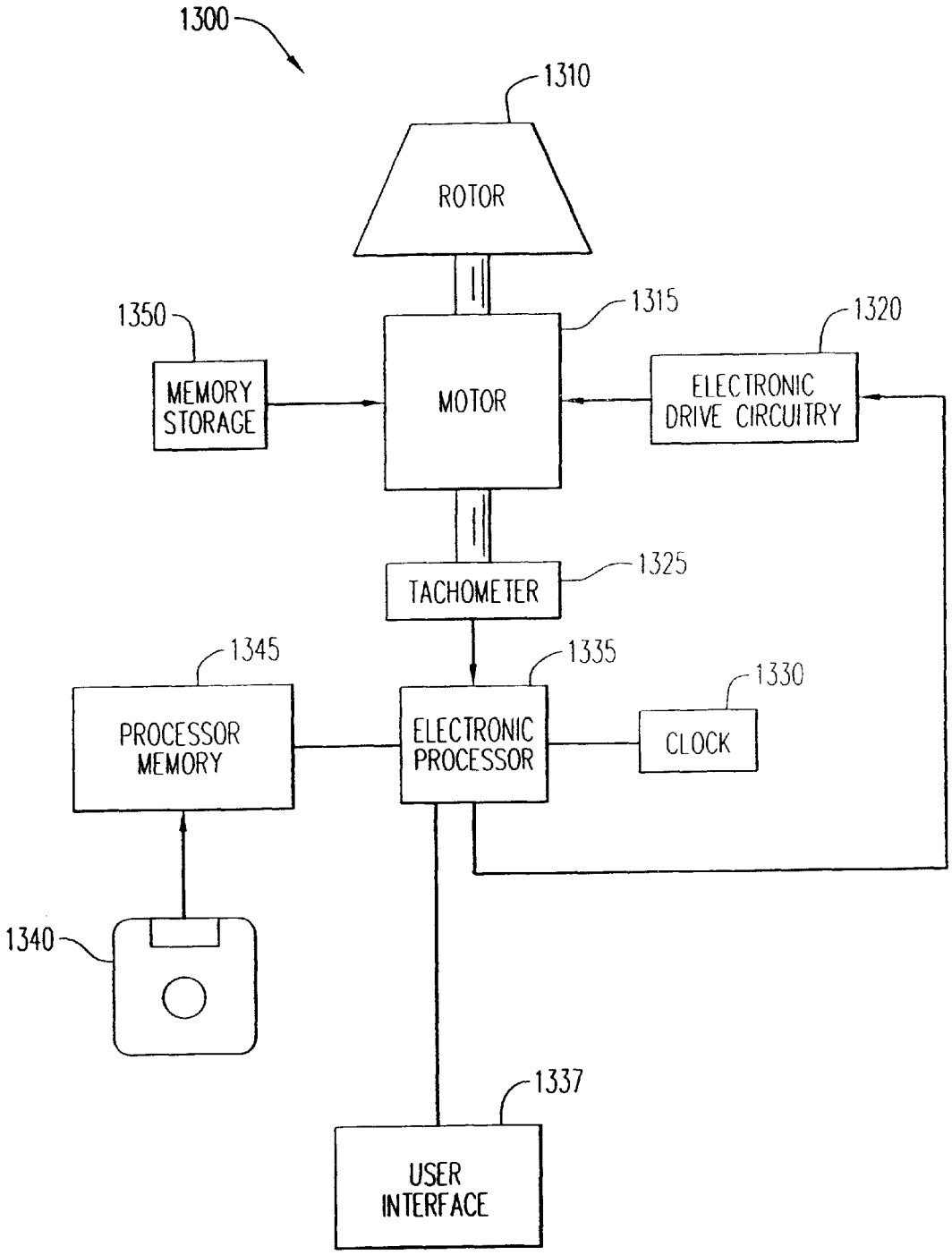
FIG. 13 is a block diagram of a centrifuge system particularly suited to carry out the present invention.

FIG. 13 is a block diagram of a centrifuge system 1300, particularly suited to carry out the present invention. The principal components of the system include a rotor 1310, a motor 1315 with an associated memory storage 1350, an electronic drive circuit 1320, a tachometer 1325, and an electronic processor 1335 with an associated processor memory 1345 and a clock 1330, and a user interface 1337.

Rotor 1310 is mounted on motor 1315, which provides a rotational force for acceleration of rotor 1310. Motor 1315 is driven by electronic drive circuitry 1320, which applies a drive current to motor 1315 under the control of electronic processor 1335.

Tachometer 1325 is coupled to motor 1315 to measure the angular velocity, i.e., speed, of rotor 1310. The output of tachometer 1325 is reported to electronic processor 1335.

Clock 1330 measures time, including the elapsed time of a centrifuge session. The output of clock 1330 is reported to electronic processor 1335.

Memory storage 1350 contains the motor constants $K_e$ and $K_t$, described above. Electronic processor 1335 can read memory storage 1350 to obtain these constants.

User interface 1337 is an input/output device that allows a user to enter information, such as a rotor identification and desired operating speed. It also enables the system to communicate information to the user, such as the status of the centrifuge session, elapsed time, and error or fault conditions. User interface 1337 can be any conventional input/output device such as a keyboard and a digital display or video display.

Processor memory 1345 contains data and instructions for execution by electronic processor 1335. In particular, processor memory 1345 includes the various tables and instructions required to enable electronic processor 1335 to execute the methods described above and illustrated in FIGS. 1 through 12. Electronic processor 1335, clock 1330, and processor memory 1345 can be an embedded processing system within centrifuge system 1300, or alternatively, they can be part of a standalone computer system that interfaces with centrifuge system 1300. While the procedures required to execute the invention hereof are indicated as already loaded into processor memory 1345, they may be configured on a storage media, such as data memory 1340, for subsequent loading into processor memory 1345.

Those skilled in the art, having the benefit of the teachings of the present invention may impart numerous modifications thereto. Such modifications are to be construed as lying within the scope of the present invention, as defined by the appended claims.

What is claimed is:

1. A method for limiting an operating speed of a rotor installed in a centrifuge system, comprising:

(a) determining whether an actual change in energy required to accelerate said rotor from a first speed to a second speed is within a predetermined range of an expected change in energy required to accelerate said rotor from said first speed to said second speed; and (b) limiting said operating speed when said actual change in energy is not within said predetermined range of said expected change in energy.

2. The method according to claim 1, wherein step (a) comprises:

(a1) receiving a rotor identification; and (a2) determining, from said identification, said expected change in energy required to accelerate said rotor from said first speed to said second speed.

3. The method according to claim 2, wherein step (a2) comprises looking up said expected change in energy in a table indexed by said identification.

4. The method according to claim 1, wherein step (a) comprises:

(a1) accelerating said rotor to said first speed;

(a2) determining an actual energy required to accelerate said rotor to said first speed;

(a3) accelerating said rotor to said second speed;

(a4) determining an actual energy required to accelerate said rotor to said second speed; and (a5) determining a change between said actual energy required to accelerate said rotor to said second speed and said actual energy required to accelerate said rotor to said first speed.

5. The method according to claim 4, wherein step (a2) comprises:

(a2A) determining a time interval required to accelerate said rotor to said first speed;

(a2B) determining a representative speed of said rotor during said time interval;

(a2C) determining a torque exerted on said rotor during said time interval; and (a2D) determining said actual energy from said time interval, representative speed and torque.

6. The method according to claim 5, wherein step (a2C) comprises looking up said torque in a table indexed by said representative speed.

7. The method according to claim 5, wherein step (a2C) comprises calculating said torque from a motor constant and a motor current.

8. The method according to claim 5, wherein step (a2D) further comprises subtracting a motor loss selected from a group consisting of a bearing loss, a core loss and a copper loss.

9. The method according to claim 4, wherein step (a4) comprises the steps of:

(a4A) determining a time interval required to accelerate said rotor to said second speed;

(a4B) determining a representative speed of said rotor during said time interval;

(a4C) determining a torque exerted on said rotor during said time interval; and (a4D) determining said actual energy from said time interval, representative speed and torque.

10. The method according to claim 9, wherein step (a4C) comprises looking up said torque in a table indexed by said representative speed.

11. The method according to claim 9, wherein step (a4C) comprises calculating said torque from a motor constant and a motor current.

12. The method according to claim 9, wherein step (a4D) further comprises subtracting a motor loss selected from a group consisting of a bearing loss, a core loss and a copper loss.

13. The method according to claim 1, wherein step (b) comprises looking up a maximum speed in a table indexed by said actual change in energy.

* * * * *